US006825764B2

(12) United States Patent
Capobianco et al.

(10) Patent No.: US 6,825,764 B2
(45) Date of Patent: Nov. 30, 2004

(54) USER PROGRAMMABLE PORTABLE PROXIMITY DETECTOR

(75) Inventors: Anthony Capobianco, Cape Coral, FL (US); John Timothy Nolan, Cape Coral, FL (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 42 days.

(21) Appl. No.: 10/401,385

(22) Filed: Mar. 28, 2003

(65) Prior Publication Data

US 2004/0189465 A1 Sep. 30, 2004

(51) Int. Cl.[7] ..... G08B 1/08

(52) U.S. Cl. ..... 340/539.23; 340/539.11; 340/573.1; 340/573.4

(58) Field of Search ..... 340/539.11, 539.21, 340/539.23, 573.1, 573.3, 573.4, 5.6, 5.61, 7.2, 7.21; 455/456.3, 414.1

(56) References Cited

U.S. PATENT DOCUMENTS

| | | | | |
|---|---|---|---|---|
| 4,471,343 A | * | 9/1984 | Lemelson | 340/5.31 |
| 5,204,670 A | * | 4/1993 | Stinton | 340/10.5 |
| 5,218,344 A | * | 6/1993 | Ricketts | 340/573.4 |
| 5,298,883 A | | 3/1994 | Pilney et al. | 340/573.2 |
| 6,006,068 A | | 12/1999 | Elkin et al. | 455/31.3 |
| 6,021,312 A | | 2/2000 | Klein | 455/38.1 |
| 6,075,442 A | | 6/2000 | Welch | 340/573.1 |
| 6,118,380 A | | 9/2000 | Gannon | 340/573.4 |
| 6,351,656 B1 | | 2/2002 | Burgan et al. | 455/566 |
| 6,392,533 B1 | | 5/2002 | Hayakawa | 340/7.55 |
| 6,433,670 B1 | | 8/2002 | Miyashita | 340/7.51 |
| 6,507,274 B1 | | 1/2003 | Morishima | 340/7.55 |
| 6,510,642 B2 | * | 1/2003 | Riener | 42/70.11 |
| 6,618,593 B1 | * | 9/2003 | Drutman et al. | 455/456.3 |

OTHER PUBLICATIONS

Abacom Technologies: RF Wireless Transmitter,Receiver and Transceiver Modules. http://www.abacom–tech.com/encoders.htm; accessed Feb. 27, 2003.
www.spotme.info; copyright 2002.

* cited by examiner

*Primary Examiner*—Van T. Trieu
(74) *Attorney, Agent, or Firm*—Mayer Fortkort & Williams, PC; Stuart H. Mayer, Esq.

(57) ABSTRACT

A portable proximity alert detector is provided for a user to determine when at least one companion comes within a predetermined range of the user. The device includes a receiving portion for wirelessly receiving a first signal encoded with a code identifying a companion and a transmitting portion for wirelessly transmitting a second signal encoded with a user identifying code. The device also includes a processor, a modulator operationally coupling the processor to the transmitting portion for modulating the user identifying code, and a demodulator operationally coupling the processor to the receiving portion for demodulating the companion identifying code. A first memory segment is operationally coupled to the processor for storing companion identifying codes received by the receiving portion. A second memory segment is operationally coupled to the processor for storing companion identifying codes of companions whom the user desires to contact. A third memory segment operationally coupled to the processor for storing the user identifying code. A user interface is operationally coupled to the processor through which the companion identifying codes of the companions whom the user desires to contact are programmed into the second memory segment. An indicator is provided for alerting the user when at least one companion identifying codes received by the receiving portion matches one of the companion identifying codes stored in the second memory segment.

19 Claims, 1 Drawing Sheet

USER PROGRAMMABLE PORTABLE PROXIMITY DETECTOR

FIELD OF THE INVENTION

The present invention relates generally to a method and apparatus for determining when at least on individual equipped with a portable proximity detector comes within a predetermined range of a user who is also equipped with a similar portable proximity detector.

BACKGROUND OF THE INVENTION

When participating in various activities, whether outdoors, on a school campus, in a shopping mall or the like, individuals, particularly children and young adults, would like to know if a friend or companion is nearby. While a large variety of personal locating systems such as a child monitoring system are available, these systems generally do not allow two individuals to monitor the location of each other. Rather, one individual, typically an adult, can monitor the location of a second individual, typically a child, using a low power radio transmitter worn by the child. In relatively simple systems the location of the child is usually monitored so that if the child leaves a predetermined area, the radio transmitter will inform the adult. In other systems the precise location of the child can be determined, but at the expense of a more complex and physically large monitoring unit.

Even in systems in which two or more monitors are employed, each monitor is usually preprogrammed to respond to a companion monitor. That is, the user cannot customize or program one monitor to identify or otherwise respond to other such monitors as the user chooses. For example, U.S. Pat. No. 5,298,883 shows a proximity alert system in which a pair of portable transceiver units transmits a coded signal that is picked up by the other unit. The strength of the received coded signal controls the rate of an audible beeper. The rate of the beeper indicates the approximate distance between companion units.

Accordingly, it would desirable to provide a compact and inexpensive system that is also flexible and programmable, and which alerts individuals equipped with companions units when they come in proximity of one another.

SUMMARY OF THE INVENTION

In accordance with the present invention, a portable proximity alert detector is provided for a user to determine when at least one companion comes within a predetermined range of the user. The device includes a receiving portion for wirelessly receiving a first signal encoded with a code identifying a companion and a transmitting portion for wirelessly transmitting a second signal encoded with a user identifying code. The device also includes a processor, a modulator operationally coupling the processor to the transmitting portion for modulating the user identifying code, and a demodulator operatonally coupling the processor to the receiving portion for demodulating the companion identifying code. A first memory segment is operationally coupled to the processor for storing companion identifying codes received by the receiving portion. A second memory segment is operationally coupled to the processor for storing companion identifying codes of companions whom the user desires to contact. A third memory segment operationally coupled to the processor for storing the user identifying code. A user interface is operationally coupled to the processor through which the companion indentifying codes of the companions whom the user desires to contact are programmed into the second memory segment. An indicator is provided for alerting the user when at least one companion identifying codes received by the receiving portion matches one of the companion identifying codes stored in the second memory segment.

In accordance with one aspect of the invention, a housing is provided in which is secured the receiving portion, the transmitting portion, the processor, the modulator, the first, second and third memory segments, the user interface, and the indicator.

In accordance with another aspect of the invention, the housing is configured as a keychain.

In accordance with another aspect of the invention, the receiving and transmitting portions are incorporated in a transceiver.

In accordance with another aspect of the invention, the user interface is an interface port for externally programming the companion identifying codes of the companions whom the user desired to contact into the second memory segment.

In accordance with another aspect of the invention, the interface port is selected from the group consisting of a serial, infrared, USB, Bluetooth, IEEE 802.11, and an IEEE 1394 port.

In accordance with another aspect of the invention, the indicator is a visual indicator.

In accordance with another aspect of the invention, the indicator is an audio indicator.

In accordance with another aspect of the invention, the audio indicator plays a sound sequence associated with the companion who has been identified as coming within the predetermined range.

In accordance with another aspect of the invention, the audio indicator plays a different sound sequence for each different companion who has been identified as coming within the predetermined range.

In accordance with another aspect of the invention, the first and second memory segments are volatile memory segments.

In accordance with another aspect of the invention, the third memory segment is a non-volatile memory segment.

In accordance with another aspect of the invention, a method is provided for determining when at least one companion comes within a predetermined range of a user. The method begins by storing an identification code of each companion whom the user desires to contact. A first signal encoded with a code identifying a companion is received over a wireless communication link. A second signal encoded with a user identifying code is transmitted over a wireless communication link. The received companion identifying code is compared with the stored identifying codes. The user is alerted when the received companion identifying code matches one of the stored identifying codes.

DETAILED DESCRIPTION

It is worthy to note that any reference herein to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
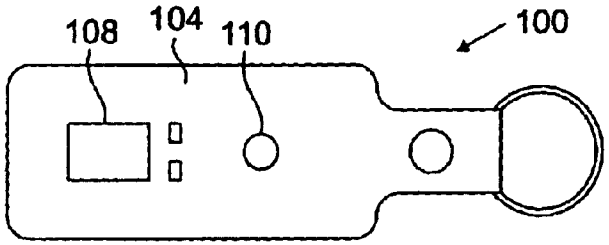
FIG. 1 shows a companion identifying device constructed in accordance with the present invention is shown.

Referring to FIG. 1 of the drawings, one of the companion identifying devices 100 constructed in accordance with the present invention is shown. Each device 100 is preferably sufficiently small so that it can be easily carried on one's person, much as a pager or similar device. In the embodiment of the invention shown in FIG. 1 the companion identifying device 100 takes the form of a keychain. Each device 100 is programmed to wirelessly transmit a unique code that identifies the user in possession of the device. Each device 100 can also receive codes from other such companion identifying devices. The received codes are compared to stored codes associated with the individuals that the user wants to identify when such individuals come in proximity to the user. In FIG. 1 the companion identifying device 100 includes a housing 104 on which is located a user interface 108 and an indicator 110 that alerts the user when a companion whose code has been previously stored in the device comes within range.

The user interface 108 allows the user to set all of the devices' user selectable features and functions. In operation, the user, via the user interface 108, programs the device 100 with one or more codes of other users who have similar devices. The user's own code, which is to be transmitted so that his or her companions can identify the user, may be preprogrammed either during manufacture or at the point of sale. Alternatively, the user can program the user's code in the same manner as companion's codes are programmed. To keep the dimensions of the device 100 to a minimum, the user interface 108 may include only a limited number of buttons such as an up/down button, an on/off button, and possibly a function/select button, for example. The user interface 108 may also contain an LCD display on which the user can view the entries selected with the buttons. The user can enter a numeric code, visible on the LCD display, which corresponds to the code of the companions who are to be identified.

In some embodiments of the invention the user interface 108 may be an interface port that allows the device 100 to be programmed via a personal computer, personal digital assistant (PDA), or other similar device. The interface port may be a conventional port such as a serial, infrared, USB, Bluetooth, IEEE 802.11, or IEEE 1394 port, for example. In such cases the number of buttons located on housing 104 can be reduced or even eliminated. Alternatively, in some embodiments of the invention the user interface may include both an interface port and user inputs such as buttons.

Once the device 100 has been properly programmed, the indicator 110 will inform the user when a companion whose code is entered in the user's device comes within signal reception range. If the device 100 receives codes from other such devices that are not programmed in the user's device, the indicator will not be activated. The indicator 110 may be visual or audio. In one embodiment of the invention the indicator is an audio transducer that plays a unique tone or tune for each pair of companions. The tone or tune may be played on both the device receiving the code and the device transmitting the code. If another companion comes within signal range whose code is programmed in the other two devices, all three devices may play yet another tone or tune that identifies the presence of all three companions. In some alternative embodiments of the invention the tone or tune may be unique to each user. In this case the tone or tune may only be played by the device or devices receiving the code and not by the transmitting device. The tone or tune associated with each companion may be programmed directly via the user interface or, using a PC, via the interface port.

Figure 2:
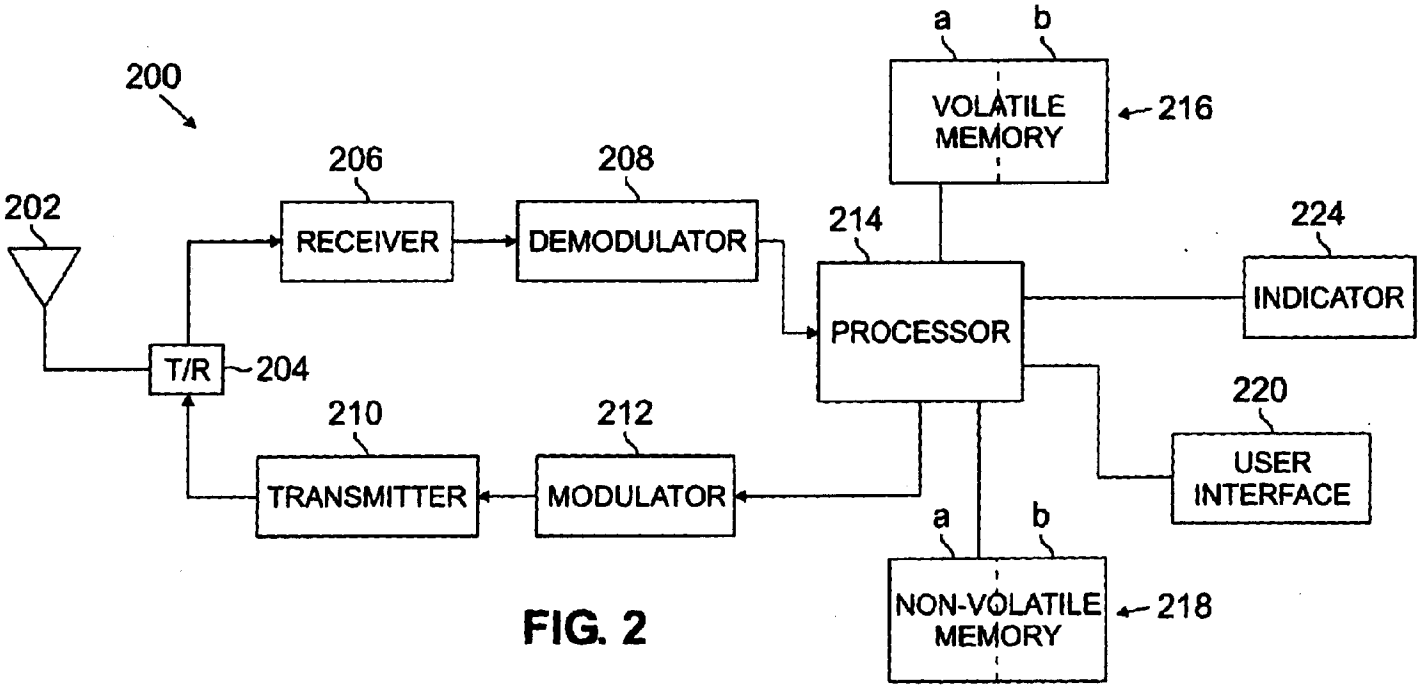
FIG. 2 shows the internal components of the companion identifying device depicted in FIG. 1.

The internal circuitry of the companion identifying device 100 is shown in FIG. 2, and includes an antenna element 202 coupled to an antenna port of an electronically controlled transmit/receive (T/R) switch 204. A receive port of the switch 204 is coupled to an input of a receiver 206 that receives the broadcast RF signals from antenna element 202 in a predetermined standard frequency band. The received signals, which are formatted in accordance with an established standard, are decoded in demodulator 208 and provided to a microprocessor/controller 214. A transmit port of the switch 204 is coupled to an output of a transmitter 210 that receives information from a modulator 212 that is to be encoded by the transmitter 210. The microprocessor/controller 214 may be in the form of, for example, a digital signal processor (DSP) or a combination of a conventional microprocessor and an application specific integrated circuit (ASIC). The user interface 220 and indicator 224 are also in communication with the processor 214.

The microprocessor/controller 214 is associated with one or more memories such as volatile memory 216 and non-volatile memory 218. Non-volatile memory 218 may be a rewritable memory such as an EEPROM or flash memory. One section 218*a* of non-volatile memory 218 may be used to store the sender's ID code that is to be broadcast by transmitter 210. Another section 218*b* of non-volatile memory 218 may be used to store programs and program related data used by microprocessor/controller 214. The volatile memory 216, which may be a random access memory, for example, has a section 216*a* for storing ID codes that are received by the receiver 206 of the companion identifying device 200. Another section 216*b* of volatile memory 216 stores the ID codes of the individuals whom the user wishes to make contact with.

The receiver 206 is under the control of microprocessor/controller 214, and employs a crystal or a frequency synthesizer for purposes of tuning as is known in the art. Likewise, the modulator 212 is coupled to the microprocessor/controller 214, and a carrier signal on which information is encoded by the transmitter 210 is derived from a frequency synthesizer in a known manner. Operating frequencies and modulation protocols used by the receiver 206 and transmitter 210 may be selected by those of ordinary skill in the art, based in part on the desired range, cost and size of the receiver 206 and transmitter 210. Since, as previously mentioned, in some embodiments of the invention the companion identifying device is to be embodied in a housing comparable in size to a keychain, the receiver and transmitter may be miniature devices that employ, for example, frequency modulation at data transmission speeds from 9600 bps to 100 Kbps, with a signal reception range of about 1000 feet or less. Thus, the device 200 is capable of establishing a direct two-way (half-duplex) communication link with companion devices 200.

While for purposes of clarity the various components depicted in FIG. 1 are shown as discrete elements, those of ordinary skill in the art will recognize that the functionality of any two or more of these elements may be combined into a single element. For example, transmitter 210 and receiver 206 may be combined into a single tranceiver unit. Likewise, modulator 212 and demodulator 208 may be combined into a single data encoder/decoder unit. Suitable tranceiver and data encoder/decoder units that are sufficiently small and which have sufficiently low power requirements are commercially available from companies such as ABACOM Technologies, for example.

The companion identifying device of the present invention has been described in terms of device that alerts the user when a companion comes within a predetermined range. In some embodiments of the invention the device may also operate in a reverse detect mode in which the device alerts the user when a companion has traveled beyond the predetermined range. That is, the device alerts the user when the companion's signal is no longer received. This mode of operation may be particularly useful when the user is a parent or guardian and the companion is a child. In this way the parent or guardian will be alerted if the child leaves a predetermined area. The user interface 108 may include a mode selector to select this mode of operation.

What is claimed is:

1. A portable proximity alert detector for a user to determine when at least one companion comes within a predetermined range of the user, comprising:

a receiving portion for wirelessly receiving a first signal encoded with a code identifying a companion;

a transmitting portion for wirelessly transmitting a second signal encoded with a user identifying code;

a processor;

a modulator operationally coupling the processor to the transmitting portion for modulating the user identifying code;

a demodulator operationally coupling the processor to the receiving portion for demodulating the companion identifying code;

a first memory segment operationally coupled to the processor for storing companion identifying codes received by the receiving portion;

a second memory segment operationally coupled to the processor for storing companion identifying codes of companions whom the user desires to contact;

a third memory segment operationally coupled to the processor for storing the user identifying code;

a user interface operationally coupled to the processor through which the companion identifying codes of the companions whom the user desires to contact are programmed into the second memory segment; and an indicator for alerting the user when at least one companion identifying codes received by the receiving portion matches one of the companion identifying codes stored in the second memory segment.

2. The portable proximity alert detector of claim 1 further comprising a housing in which is secured said receiving portion, said transmitting portion, said processor, said modulator, said first, second and third memory segments, said user interface, and said indicator.

3. The portable proximity alert detector of claim 2 wherein said housing is configured as a keychain.

4. The portable proximity alert detector of claim 1 wherein said receiving and transmitting portions are incorporated in a transceiver.

5. The portable proximity alert detector of claim 1 wherein said user interface is an interface port for externally programming the companion identifying codes of the companions whom the user desired to contact into the second memory segment.

6. The portable proximity alert detector of claim 5 wherein said interface port is selected from the group consisting of a serial, infrared, USB, Bluetooth, IEEE 802.11, and IEEE 1394 port.

7. The portable proximity alert detector of claim 1 wherein said indicator is a visual indicator.

8. The portable proximity alert detector of claim 1 wherein said indicator is an audio indicator.

9. The portable proximity alert detector of claim 8 wherein said audio indicator plays a sound sequence associated with said at least one companion who has been identified as coming within the predetermined range.

10. The portable proximity alert detector of claim 9 wherein said audio indicator plays a different sound sequence for each different companion who has been identified as coming within the predetermined range.

11. The portable proximity alert detector of claim 1 wherein said first and second memory segments are volatile memory segments.

12. The portable proximity alert detector of claim 11 wherein said third memory segment is a non-volatile memory segment.

13. A method for determining when at least one companion comes within a predetermined range of a user, said method comprising the steps of:

storing an identification code of each companion whom the user desires to contact;

receiving over a wireless communication link a first signal encoded with a code identifying a companion;

transmitting over a wireless communication link a second signal encoded with a user identifying code;

comparing said received companion identifying code with said stored identifying codes; and alerting the user when said received companion identifying code matches one of said stored identifying codes.

14. The method of claim 13 wherein the storing step includes the step of receiving over a user interface the identification code each companion to be stored.

15. The method of claim 14 wherein said user interface is selected from the group consisting of a serial, infrared, USB, Bluetooth, IEEE 802.11, and IEEE 1394 port.

16. The method of claim 13 wherein the alerting step includes the step providing a visual indication when said received companion identifying code matches one of said stored identifying codes.

17. The method of claim 13 wherein the alerting step includes the step providing an audio indication when said received companion identifying code matches one of said stored identifying codes.

18. The method of claim 17 wherein said audio indication is a sound sequence associated with each of the companions who has been identified as coming within the predetermined range.

19. The method of claim 18 wherein said audio indicator plays a different sound sequence for each different companion who has been identified as coming within the predetermined range.

* * * * *

UNITED STATES PATENT AND TRADEMARK OFFICE

CERTIFICATE OF CORRECTION

PATENT NO. : 6,825,764 B2
DATED : November 30, 2004
INVENTOR(S) : Anthony Capobianco et al.

It is certified that error appears in the above-identified patent and that said Letters Patent is hereby corrected as shown below:

Title page,
Item [57], ABSTRACT,
Line 18, after "segment," insert -- is --.
Line 24, after "identifying", change "codes" to -- code --.

Column 1,
Line 7, after "least", change "on" to -- one --.
Line 40, before "desirable", insert -- be --.
Line 42, change last word "companions" to -- companion --.
Line 64, after "segment," insert -- is --.

Column 2,
Line 4, after "identifying", change "codes" to -- code --.
Line 21, after "user", change "desired" to -- desires --.
Line 61, after "invention" delete "is shown".

Column 5,
Line 4, before "device", insert -- a --.
Line 46, after "identifying", change "codes" to -- code --.

Column 6,
Line 40, after "code", insert -- of --.
Lines 45 and 49, after "step", insert -- of --.

Signed and Sealed this

Twelfth Day of July, 2005

JON W. DUDAS
*Director of the United States Patent and Trademark Office*

UNITED STATES PATENT AND TRADEMARK OFFICE

CERTIFICATE OF CORRECTION

PATENT NO. : 6,825,764 B2
APPLICATION NO. : 10/401385
DATED : November 30, 2004
INVENTOR(S) : Capobianco et al.

It is certified that error appears in the above-identified patent and that said Letters Patent is hereby corrected as shown below:

(57) Abstract, line 7, after "a", change "user identifying" to -- user-identifying --.

(57) Abstract, line 9, change last word "user" to -- user- --.

(57) Abstract, line 12, change first words "companion identifying" to

-- companion-identifying --.

(57) Abstract, lines 13-14, change last word "companion" to -- companion- --.

(57) Abstract, line 16, after "storing", change "companion identifying" to

-- companion-identifying --.

(57) Abstract, line 19, after "the", change "user identifying" to -- user-identifying --.

(57) Abstract, line 20, change last word "companion", to -- companion- --.

(57) Abstract, line 24, after "one", change "companion identifying" to

-- companion-identifying --.

(57) Abstract, line 25, after "the", change "companion identifying" to

-- companion- identifying --.

Col. 1, line 53, change last word "user" to -- user- --.

Col. 1, line 60, after "storing", change "companion identifying" to
-- companion-identifying --.

Col. 1, line 65, after "the", change "user identifying" to
-- user-identifying --.

UNITED STATES PATENT AND TRADEMARK OFFICE

CERTIFICATE OF CORRECTION

PATENT NO. : 6,825,764 B2
APPLICATION NO. : 10/401385
DATED : November 30, 2004
INVENTOR(S) : Capobianco et al.

It is certified that error appears in the above-identified patent and that said Letters Patent is hereby corrected as shown below:

Col. 4, line 50, after “the”, change “companion identifying” to

-- companion-identifying --.

Col. 4, line 63, after “single”, change “tranceiver” to -- transceiver --.

Col. 4, line 66, change first word “tranceiver” to -- transceiver --.

Col. 5, line 3, after first word “the”, change “companion identifying” to

-- companion-identifying --

Signed and Sealed this

Ninth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 6,825,764 B2
APPLICATION NO. : 10/401385
DATED : November 30, 2004
INVENTOR(S) : Capobianco et al.

It is certified that error appears in the above-identified patent and that said Letters Patent is hereby corrected as shown below:

(57) Abstract, line 7, after “a”, change “user identifying” to -- user-identifying --.

(57) Abstract, line 9, change last word “user” to -- user- --.

(57) Abstract, line 12, change first words “companion identifying” to

-- companion-identifying --.

(57) Abstract, lines 13-14, change last word “companion” to -- companion- --.

(57) Abstract, line 16, after “storing”, change “companion identifying” to

-- companion-identifying --.

(57) Abstract, line 19, after “the”, change “user identifying” to -- user-identifying --.

(57) Abstract, line 20, change last word “companion”, to -- companion- --.

(57) Abstract, line 24, after “one”, change “companion identifying” to

-- companion-identifying --.

(57) Abstract, line 25, after “the”, change “companion identifying” to

-- companion- identifying --.

Col. 1, line 53, change last word “user” to -- user- --.

Col. 1, line 60, after “storing”, change “companion identifying” to
-- companion-identifying --.

Col. 1, line 65, after “the”, change “user identifying” to
-- user-identifying --.

UNITED STATES PATENT AND TRADEMARK OFFICE

CERTIFICATE OF CORRECTION

PATENT NO. : 6,825,764 B2
APPLICATION NO. : 10/401385
DATED : November 30, 2004
INVENTOR(S) : Capobianco et al.

It is certified that error appears in the above-identified patent and that said Letters Patent is hereby corrected as shown below:

Col. 1, line 67, after “the”, change “companion identifying” to

-- companion-identifying --.

Col. 2, line 3, after “one”, change last word “companion” to

-- companion- -- .

Col. 2, line 5, after “the”, change “companion identifying” to

-- companion-identifying --.

Col. 2, line 20, after “the”, first occurrence, change “companion identifying” to -- companion-identifying --.

Col. 2, line 53, after “received”, change “companion identifying” to

-- companion-identifying --.

Col. 2, lines 54 & 55, after “received”, change “companion identifying” to

-- companion-identifying --.

Col. 2, line 56, after “received”, change “companion identifying” to

-- companion-identifying --.

Col. 2, line 60, after “a”, change “companion identifying” to

-- companion identifying --.

Col. 2, line 62, change last word “companion” to -- companion- -- .

Col. 3, line 6, change last word “companion” to -- companion- --.

Col. 3, line 11, change last word “companion” to -- companion- -- .

Col. 3, lines 15-16, after “such”, change “companion identifying” to

-- companion-identifying --.

UNITED STATES PATENT AND TRADEMARK OFFICE

CERTIFICATE OF CORRECTION

PATENT NO. : 6,825,764 B2
APPLICATION NO. : 10/401385
DATED : November 30, 2004
INVENTOR(S) : Capobianco et al.

It is certified that error appears in the above-identified patent and that said Letters Patent is hereby corrected as shown below:

Col. 3, line 19, after “the”, second occurrence, change “companion identifying”

to -- companion-identifying --.

Col. 3, line 25, after first word “devices’ ”, change “user selectable” to

-- user-selectable --.

Col. 4, line 5, after “the”, change “companion identifying” to

-- companion-identifying --.

Col. 4, line 34, change last word “companion” to -- companion- -- .

Col. 4, line 50, after “the”, change “companion identifying” to

-- companion-identifying --.

Col. 4, line 63, after “single”, change “tranceiver” to -- transceiver --.

Col. 4, line 66, change first word “tranceiver” to -- transceiver --.

UNITED STATES PATENT AND TRADEMARK OFFICE

CERTIFICATE OF CORRECTION

PATENT NO. : 6,825,764 B2
APPLICATION NO. : 10/401385
DATED : November 30, 2004
INVENTOR(S) : Capobianco et al.

It is certified that error appears in the above-identified patent and that said Letters Patent is hereby corrected as shown below:

Col. 5, line 3, after first word "the", change "companion identifying" to

-- companion-identifying --

This certificate supersedes Certificate of Correction issued January 9, 2007.

Signed and Sealed this

Fifteenth Day of May, 2007

JON W. DUDAS
*Director of the United States Patent and Trademark Office*